US006058668A

United States Patent [19]

Herren

[11] Patent Number: 6,058,668

[45] **Date of Patent: *May 9, 2000**

[54] SEISMIC AND FIRE-RESISTANT HEAD-OF-WALL STRUCTURE

[76] Inventor: Thomas R. Herren, 1160 N. Blue Gum Ave., Anaheim, Calif. 92806

[ * ] Notice: This patent is subject to a terminal disclaimer.

[21] Appl. No.: 09/059,708

[22] Filed: Apr. 14, 1998

[51] Int. Cl.[7] ..... E04B 1/94; E04B 2/28

[52] U.S. Cl. ..... 52/241; 52/236.7; 52/481.1

[58] Field of Search ..... 52/241, 236.7, 52/481.1, 262, 336, 221, 450, 576, 577, 503, 483.1, 334, 243, 236.9, 265, 267

[56] References Cited

U.S. PATENT DOCUMENTS

| | | | |
|---|---|---|---|
| 3,702,044 | 11/1972 | Balinski | 52/30 |
| 4,106,249 | 8/1978 | Morton . | |
| 4,761,928 | 8/1988 | Pichette . | |
| 5,113,631 | 5/1992 | DiGirolamo et al. | 52/236.8 |
| 5,127,203 | 7/1992 | Paquette . | |
| 5,127,760 | 7/1992 | Brady . | |
| 5,412,919 | 5/1995 | Pellock et al. | 52/656.1 |
| 5,737,895 | 4/1998 | Perrin | 52/745.1 |
| 5,755,066 | 5/1998 | Becker | 52/241 |
| 5,913,788 | 6/1999 | Herren | 52/241 |

OTHER PUBLICATIONS

Thermafiber Life–Safety Fire Containment Systems, SA 707; pp. 1–14 By USG Interiors, Inc., Jan. 1996.

*Primary Examiner*—Carl D. Friedman
*Assistant Examiner*—Dennis L. Dorsey
*Attorney, Agent, or Firm*—Charles H. Thomas

[57] ABSTRACT

An improved head-of-wall structure for an interior, nonload-bearing building wall is provided in which a pair of elongated angle strips are employed to connect the upper ends of to the upright metal studs fluted metal decking above in a seismic and fire-resistant manner. A plurality of uniformly spaced pop-up tabs are defined in the horizontal legs of the angle strips directly beneath the open flutes or channels of the metal decking above. Insulation supports are located beneath the ceiling flutes to span the distance between the angle strips. The insulation supports are connected to the vertical legs of the angle strips to form flat, horizontal platforms directly beneath the portions of the flutes that cross the line of studs. Batts of fire-proofing insulation are located atop the insulation supports and are held in position by bending up the pop-up tabs from their original horizontal disposition into a generally vertical orientation.

19 Claims, 4 Drawing Sheets

SEISMIC AND FIRE-RESISTANT HEAD-OF-WALL STRUCTURE

BACKGROUND OF THE INVENTION

1. Field of the Invention

The present invention relates to a system for creating a seismic-resistant and fire-resistant head-of-wall structure for a nonload-bearing wall within a building.

2. Description of the Prior Art

Seismic and fire resistance has become of increasing concern in building construction. In the construction of buildings the framework for the walls of a building is formed of horizontal still members at the floor, at the ends of which vertical corner posts support horizontal beams at the ceiling level. Between the corner posts there are upright supports, called studs, laterally spaced, usually at uniform intervals, to provide the necessary interior structural support for the wall.

Historically, the framework of a building wall was formed entirely of wooden members, including wooden studs. In recent years, however, the use of metal studs has gained increased acceptance, especially in the construction of commercial buildings, such as office buildings, schools, and hospitals. Metal building studs are typically formed of ten to twenty gauge galvanized steel. For ease of fabrication the metal studs are formed of sheet metal bent into a generally "C-shaped" cross section. A relatively broad central web is flanked by a pair of narrower side walls that are bent at right angles to the web or base. The edges of the side walls of the metal stud are normally bent over into a plane parallel to and spaced from the plane of the web.

In the conventional construction of an interior building wall an overhead beam having a U-shaped configuration extends along the tops of the studs. The overhead beam is formed with a horizontally disposed web from which a pair of side walls depend vertically on opposite sides of the web. The side walls embrace the sides of the vertical studs so that the upper extremities of the studs extend in a perpendicular manner into the concave, downwardly facing channel formed by the overhead beam. The spacing of the studs along the length of the beam is typically either sixteen or twenty-four inches.

One problem which occurs in any building during an earthquake is that the seismic ground motion from an earthquake introduces both horizontal and vertical undulations in the building. Because of their elongated, vertical lengths, the metal studs in building wall construction are limber enough to flex sufficiently in a lateral direction and thereby resist inelastic deformation during an earthquake. However, vertical undulations that vary the distance between the floor and ceiling in a room during an earthquake are likely to destroy, or at least damage the integrity, of rigid structural joints between vertical metal studs and horizontal sill and overhead beam members between which the studs extend in a building.

Another problem which may occur is the spread of fire from room to room within a building. While the structure of interior building walls is largely formed of fire-resistant gypsum board sheet, fire can pass between the upper edges of the gypsum board and the ceiling. Fire paths are particularly likely to develop if the joints between the metal studs in the walls and the ceiling above have been damaged by prior seismic activity.

To alleviate these problems a seismic and fire resistant wall structure and method was devised. This system is described in U.S. Pat. No. 5,127,203. According to this system the overhead, downwardly facing, U-shaped beam that extends across the top of the upright studs is provided with fire-retardant material on its underside and with vertical sides that have vertically elongated slots defined thereon. These vertically elongated slots are longitudinally spaced at intervals to accommodate the positions of studs within a vertical, nonload-bearing wall. Fasteners extend through the vertically elongated slots in the overhead beams and into the sides of the metal studs. The fasteners, typically sheet metal screws, are tight enough to provide lateral stability at the joints between the studs and the overhead beam, but are not so tight as to prevent relative vertical motion therebetween.

Preferably, standoff washers are provided at the elongated slots. The standoff washers have faces against which the heads of the screws bear and short legs or flanges which project through the vertically elongated slots in the side walls of the overhead beams. These flanges bear against the sides of the studs. The standoff washers function in the manner depicted and described in U.S. Pat. No. 5,467,566, with specific reference to FIG. 8 of that patent.

As vertical undulations from an earthquake are transmitted through the structural components of a nonload-bearing wall as described in U.S. Pat. No. 5,127,203, the elongated, vertical slots through which the stud fasteners extend permit vertical, oscillatory motion to occur between the upper extremities of the studs and the overhead beams of the nonload-bearing walls. As a result, the stud fasteners maintain structural integrity so that the wall remains undamaged and does not require repair following an earthquake.

In a nonload-bearing wall the web of the beam is preferably secured to the ceiling above by screws that extend vertically upwardly through longitudinally elongated slots in the web of the beam and into the structure of the ceiling above.

These screws also preferably employ standoff washers of the type described in U.S. Pat. No. 5,467,566 so that the head-of-wall structure can accommodate limited interstory drift during an earthquake.

A problem which continues to exist in building construction is the difficulty in making a nonload-bearing wall adequately fire resistant. In a typical building construction a ceiling is formed by galvanized steel, fluted decking atop which a layer of concrete is poured to form the floor above. The fluted steel decking may, for example, be fabricated of eighteen gauge galvanized steel. The flutes, or concave, downwardly facing channels defined in the underside of the decking, are typically about three inches deep and about six inches wide.

Interior, nonload-bearing walls often pass transversely across the flutes. The beams at the tops of such walls are attached to the underside of the decking where the decking projects downwardly between the hollow flutes. Openings having cross-sectional areas equal to the areas of the flutes are thereby formed above the beams that are located at the top of nonload-bearing, interior walls. These openings form transverse passageways across the tops of the walls through which fire can travel.

To prevent the spread of fire through the flutes formed by the decking above nonload-bearing, interior walls, fire-resistant insulation is packed in the flute openings created at the tops of the walls by the flutes. This fire-resistant insulation may be applied by spraying it into the flute openings from each side of the wall. When the insulation dries and congeals it clogs the flute openings at the top of the wall.

As long as the insulation remains in the flute openings, they remain blocked and the insulation prevents the spread of fire across the top of the wall. However, when a fire is burning within a building, it generates a considerable amount of smoke which is heated and expands. The smoke causes a great pressure within a room where a fire is burning. It is known that the pressure of smoke from a fire burning within a room literally blasts the fire insulation out of the flute openings atop the wall. When this occurs the fire can thereupon spread to an adjacent room over the top of the wall through the flute openings.

According to present building construction practice fire insulation is held within the tunnel cavities defined by the flutes of the decking by hand cutting the upper edges of the gypsum board wall panels to follow the corrugations of the decking. The wallboard panels forming the sides of the nonload-bearing walls provide a series of projections that block the flute tunnels from the opposite sides of the wall and thereby hold the insulation in place. However, this system for holding the insulation in position is extremely time consuming, laborious, and expensive.

Hand cutting of the upper region of the wall to follow the convolutions of the corrugated, fluted decking is extremely labor intensive. The labor cost in creating a scalloped upper edge at the top of the wallboard adds significantly to the cost of construction of the wall. Moreover, even if a template is used the hand cuts result in significant gaps remaining which must then be caulked. The process of caulking is also an extremely laborious, labor intensive process, particularly when it is necessary to follow the convolutions of the underside of the fluted decking.

Moreover, conventional caulking is not seismic resistant. That is, even if the caulking originally provides an effective barrier to air currents, if the building structure subsequently is subjected to seismic activity, the caulking crumbles and gaps that allow the passage of air currents are opened. When this occurs the wall no longer offers its original resistance to the spread of fire. As a result, it has not heretofore been possible to provide both seismic resistance and fire resistance in interior building walls that will meet the stringent building codes applicable to structures such as schools and hospitals.

While the system of U.S. Pat. No. 5,127,203 does allow limited vertical cycling at the head-of-wall structure, it does not provide any means for retaining the insulation within the flutes of decking above the downwardly facing overhead channel-shaped beams. Also, slotted beams must be stocked having webs of the various different sizes that are used in different building head-of-wall structures. That is, the webs are typically provided in about six different widths varying between two and a half and eight inches.

SUMMARY OF THE INVENTION

According to the present invention, a system has been devised which accommodates both vertical and horizontal seismic movement, as in the system of U.S. Pat. No. 5,127,203, but which also retains the insulation in the flutes of the decking above interior walls. In addition, the system of the present invention uses a single size, angle-shaped structure to accommodate walls of all different thicknesses.

Elongated, angle-shaped sheet metal strips are provided outside of the vertical studs on both sides of the wall. Each sheet metal strip has a vertical leg which is slotted in the manner depicted in U.S. Pat. No. 5,127,203. The other leg of each angle strip is turned outwardly from the studs and bears against the underside of the decking. Also, the horizontal, outwardly projecting leg of each angle strip is cut periodically with diverging slits to form pop-up tab structures at periodic intervals along the length of the angle strip. The pop-up tabs are formed by slits cut into the outer edges of the horizontal legs of the angle strips so that the shape of the pop-up tabs conforms to and is substantially the same as the cross-sectional area of the sheet metal decking flutes. In addition, longitudinal score lines are formed across the bases of the pop-up tabs to facilitate bending these tabs upwardly.

The slotted angle strips are secured to the vertical studs with sheet metal screws and preferably also standoff washers. The screws project through the vertical, slotted legs of the angle strips and into the vertical sides of the metal studs. The standoff washers permit limited vertically reciprocal movement between the vertical slotted legs of the angle strips and the upright studs.

Longitudinally elongated slots are also preferably formed in the outwardly projecting, horizontal legs of the angle strips between the pop-up tabs. Sheet metal screws used in conjunction with standoff washers project upwardly through the slots in the horizontal angle legs and into the portions of the fluted decking that make contact therewith. Thus, the system accommodates horizontal, interstory drift, or relative movement between the horizontal legs of the angle strips and the fluted decking thereabove.

Once the screws have been used to attach the vertical legs of the angle strips to the upright studs and the horizontal legs of the angle strips to the fluted decking above, insulation batts are inserted into the flutes above the webs of bridge members that are formed as short channel-shaped sections that are secured between the angle strips at the flutes. The webs of these short, channel-shaped bridge sections support the insulation batts from beneath. Once the insulation batts are in position, the popup tabs between the slits in the horizontal legs of the angle strips are bent upwardly to a generally vertical orientation, thereby holding the insulation batts in position in the cavities in the flutes above the channel-shaped bridge sections therebeneath.

In the building construction industry the structure at the intersection between the top of an interior building wall and the ceiling deck of the floor above is referred to as a head-of-wall. There are a number of regulatory building code requirements specified for head-of-wall structures.

A principal object of the present invention is to provide an interior building wall construction that will meet both stringent seismic and stringent fire resistance code standards. For example, the UL (Underwriter's Laboratory) Standard 2079 requires that joints in metal stud framing withstand twenty cycles of a one-half inch linear movement of the structures joined together. The wall system of the present invention successfully withstands cycling of one hundred cycles of one full inch of linear movement.

Also, UL Specification 2079 additionally requires the joints of a wall to remain fire resistant for a full hour, in the case of some interior walls, and for two hours in the case of others. After subjecting the wall to fire, the wall joint and the insulation in the cavities of the flutes atop the wall must withstand the pressure applied by a stream of water directed thereon from a firehose to simulate the pressure produced within a building due to fire. Specifically, water under a pressure of forty psi in a two inch diameter hose is fired at the insulation pockets in the flutes of the ceiling from a distance of twenty feet for twenty seconds.

In conventional building construction systems the blast from the fire hose readily dislodges the insulation from the cavities created by the flutes above the wall beam unless the wallboard has been cut to follow the undulations of the ceiling flutes and thereby protect the insulation. However, the system of the present invention employs a unique technique for anchoring the insulation in position in the flute cavities above the wall so that it is entirely unnecessary to cut the wallboard to match the undulations of the ceiling flutes.

In testing building wall systems for fire resistance, the joints are expanded to the maximum joint opening width for which the system is intended to function. Thus, it is evident that conventional design features that tend to enhance seismic resistance tend to reduce fire resistance. That is, if there is considerable play in the joints between upright metal studs and overhead metal beams to which the studs are attached, openings are created which reduce resistance to the passage of fire. On the other hand, if joints are closed and locked immovably together, they are likely to fail when subjected to seismic activity. Thus it has heretofore not been possible to provide an interior building wall construction system which meets both the maximum standards for fire resistance and the maximum standards for resistance to seismic movement as well. However, the system of the present invention easily surpasses the most stringent fire and seismic resistance code specifications that are currently in use.

Another primary object of the present invention is to provide a fire and seismic resistant wall construction that maintains its resistance to fire even after being subjected to seismic activity. The system of the present invention employs a unique system for providing a head-of-wall structure with seismic resistance and also for anchoring batts of insulation in position in the flute cavities of a ceiling above a line of vertical sheet metal studs that form the structural support for an interior, nonload-bearing wall.

Unlike prior systems, there is no necessity for a concave, downwardly facing channel-shaped beam to be positioned atop the upper ends of the studs and secured both to the ceiling and to the studs. To the contrary, in place of such a channel-shaped beam, the system of the present invention employs a pair of elongated, sheet metal angle strips. Each angle strip is of an inverted L-shaped cross section having both a vertical leg and a horizontal leg. The angle strips are positioned at to extend horizontally along the line of the upper ends of vertically oriented sheet metal studs with the vertical legs of the angle strips in contact with the upper ends of the sides of the studs. The horizontal legs of the angle strips are directed outwardly, away from the vertical legs and away from the studs. The horizontal legs reside in contact with the underside of the sheet metal deck forming the ceiling.

The angle strips are preferably secured to the upper ends of the metal studs with seismic fasteners that accommodate limited relative vertical movement between the studs and the ceiling. Similarly, the horizontal legs of the angle strips are preferably secured with seismic-resistant fasteners to the underside of the metal deck so as to accommodate limited horizontal movement, or interstory drift, between the vertical studs and the ceiling deck thereabove.

The horizontally disposed legs of the angle strips have outer edges, remote from the vertical legs and remote from the upright metal studs. The horizontal legs of the metal strips are scored or slit so as to define pop-up tabs at spaced intervals along the lengths of the angle strips equal to the spaced intervals of the flutes in the metal deck located thereabove. When the wall is oriented perpendicular to the flutes in the metal deck of the ceiling, the pop-up tabs can be bent out of the original horizontal plane of the horizontal legs of the angle strips upwardly into the downwardly facing flutes. The pop-up tabs are of a size and shape so as to extend substantially across the entire width and throughout the entire depth of the flutes, thereby forming metal barriers in the flutes.

Scoring of the horizontal leg can be performed either by creating a continuous slit entirely through the sheet metal structure, or by discontinuous cutting leaving only narrow regions of uncut metal. Preferably the slits are continuous and extend inwardly toward the vertical legs from the outside edges of the horizontal legs of the angle strips to create the pop-up tabs.

According to the system of present invention, the overhead channel-shaped beam with slotted sides atop the studs is eliminated. Preferably, short sections of unslotted, sheet metal, channel-shaped, bridge members are fastened to the angle strips by screws that extend through the slots in the vertical legs of the angle strips beneath the open flutes in the decking thereabove.

Before bending the metal pop-up tabs out of the planes of the horizontal legs of the angle strips in which they are formed, batts of insulation are first positioned in the flutes directly above the line of upright studs where the flutes pass across the line of studs. The batts of insulation are preferably supported from beneath by the insulation supporting bridges. These insulation supporting bridges each have a flat, horizontally disposed web equal to the width of the webs of the studs with downwardly projecting channel sides. The channel sides are secured by sheet metal screws to the vertical legs of the angle strips so that the webs of the insulation supporting bridges form platforms directly beneath the batts of insulation located in the flute. Once the pop-up tabs of the pair of angle strips are bent into a generally vertical disposition, the batts of insulation are thereby entrapped within the flute directly above the line of upright studs from beneath by the insulation supporting bridges, and at both sides of the wall by the pop-up tabs.

In one broad aspect the present invention may be considered to be an improvement in a building interior head-of-wall structure for a nonload-bearing wall in which a plurality of vertical metal wall studs are arranged in a straight horizontal line and project upwardly and terminate beneath a ceiling formed of a metal deck having an exposed undersurface that defines a plurality of mutually parallel, downwardly facing flutes. The improvement of the invention is comprised of a pair of sheet metal angle strips that join the wall studs to the ceiling deck. The angle strips each include a vertical leg secured to the metal wall studs and a horizontal leg having an outer edge remote from the vertical leg. The horizontal leg is scored toward the vertical leg at longitudinally spaced intervals along the outer edge to define a plurality of pop-up tabs that are bendable to project upwardly into and block the flutes on both sides of the line of metal studs.

Quite often in the construction of interior building walls, the flutes of the sheet metal ceiling deck extend transversely across the line of metal studs. In such a situation, batts of fire-resistant insulation are located in each of the flutes directly above the line of wall studs. The pop-up tabs of the pair of angle strips are bent upwardly into a generally vertical disposition within the flutes. The pop-up tabs thereby block any longitudinal movement of the batts of insulation along the lengths of the flutes.

To support the insulation batts from beneath, short, channel-shaped bridge members are provided to serve as insulation supports. These bridge members have downwardly depending legs that are secured to the pair of angle strips beneath each of the batts of insulation. The enclosures thus formed are thereby are confined on all sides by the insulation supports beneath, the fluted decking material above, and the pop-up tabs at opposite ends of the enclosures. The batts of insulation within the enclosures formed in the flutes are supported from beneath by the webs of the insulation supporting bridges above the line of metal studs. As a consequence, if a fire occurs within a room on one side of the wall, the resultant pressure cannot force the batts of insulation out of their fire blocking positions atop the wall within the ceiling flutes.

In a typical building installation, the downwardly facing flutes in the sheet metal ceiling deck have a trapezoidal configuration. The horizontal legs of the angle strips are therefore scored with slits diverging from the outer edges thereof to create the pop-up tabs in a trapezoidal shape corresponding to the cross-sectional shape of the flutes.

To facilitate bending of the pop-up tabs into a vertical disposition, the pop-up tabs are partially scored above the vertical legs of the angle strips and in a direction parallel to the line of studs. Scoring may be formed by a line of intermittent perforations or by a continuous line of weakness in the metal parallel to the line of studs. The scoring is significant enough to allow the pop-up tabs to be bent upwardly using a hammer, but is not so pronounced that the pop-up tabs are likely to separate from the angle strips in which they are formed.

To accommodate limited interstory drift, ceiling fastener openings are defined in the horizontal angle legs between the pop-up tabs. The ceiling fastener openings are elongated in a direction parallel to the line of metal wall studs. Preferably a ceiling fastener slip washer is located in at least some of the ceiling fastener openings and ceiling fastening screws extend through the ceiling fastener slip washers to attach the horizontal legs of the pair of angle strips to the metal deck.

To accommodate limited vertical movement between the wall studs and the ceiling above that results from seismic events, vertically elongated stud fastener openings are defined in the vertical angle legs. Stud fastener slip washers are located in at least some of the stud fastener openings at each of the studs. Stud fastening screws extend through the stud fastener slip washers and into the studs to attach the vertical legs of the pair of angle strips to the vertical studs.

In another aspect the invention may be considered to be a new combination of elements including a building ceiling, a line of sheet metal wall studs, and a pair of elongated angle strips. The building ceiling is formed of a metal deck having an undersurface that defines a plurality of mutually parallel, concave downwardly facing flutes. A plurality of upright, channel-shaped metal wall studs are arranged in a straight, horizontal line. Each wall stud has a vertically disposed web between a pair of opposing sides. The wall studs are located beneath and extend proximate to the undersurface of the metal deck. Each of the angle strips has a vertical leg and a horizontal leg.

The vertical legs of the angle strips are formed with vertically elongated stud fastener openings therein, while the horizontal legs are formed with horizontally elongated ceiling fastener openings therein. The angle strips are respectively arranged against the opposing sides of the wall studs with their vertical legs in contact therewith and with their horizontal legs projecting outwardly therefrom away from each other. The horizontal legs of the angle strips have outer edges and are slit from the outer edges in toward the vertical legs to define pop-up tabs.

The pop-up tabs so defined have lines of bending parallel to the vertical legs. Stud fasteners extend into the metal studs through at least some of the stud fastener openings to secure the vertical legs of the angle strips to the stud walls while permitting limited relative vertical movement therebetween. Ceiling fasteners extend into the ceiling through at least some of the ceiling fastener openings to secure the horizontal legs of the angle strips to the ceiling, while permitting limited relative horizontal movement therebetween.

In still another aspect the invention may be considered to be a seismic and fire-resistant interior head-of-wall structure. The head-of-wall structure of the invention is installed between a ceiling formed of a metal deck with an exposed undersurface that defines a plurality of mutually parallel, concave downwardly facing flutes, and a plurality of vertical metal studs extending upwardly and arranged in linear alignment with each other. The vertical studs terminate near the ceiling beneath the undersurface thereof.

According to the invention a pair of elongated sheet metal angle strips are provided. Each angle strip has a vertical leg and a horizontal leg and is positioned beneath the undersurface of the ceiling. The vertical legs of the angle strips depend from the horizontal legs thereof and reside in contact with the metal studs. The horizontal legs of the angle strips are directly outwardly away from the metal studs and reside in contact with the undersurface of the metal deck.

The angle strips are formed with a plurality of vertically elongated stud fastener openings defined in the vertical legs of the angle strips. A plurality of horizontally elongated ceiling fastener openings are defined in the horizontal legs of the angle strips. The ceiling fastener openings extend parallel to the alignment of the studs relative to each other. Stud fasteners extend through at least some of the stud fastener openings and into the metal studs to secure the vertical legs of the angle strips to the vertical studs. This permits relative vertical movement between the angle strips and the vertical studs, limited by the lengths of the stud fastener openings.

Similarly, ceiling fasteners extend through at least some of the ceiling fastener openings and into the metal deck to secure the horizontal legs of the angle strips to the metal deck. This permits limited horizontal movement between the ceiling and the angle strips. This movement is limited by the lengths of the ceiling fastener openings.

Slits are formed in the horizontal legs of the angle strips. These slits define pop-up tabs in the horizontal legs which are of a size that fit into and extend transversely across the downwardly facing flutes.

The invention may be described with greater clarity and particularity by reference to the accompanying drawings.

DESCRIPTION OF THE EMBODIMENT

Figure 1:
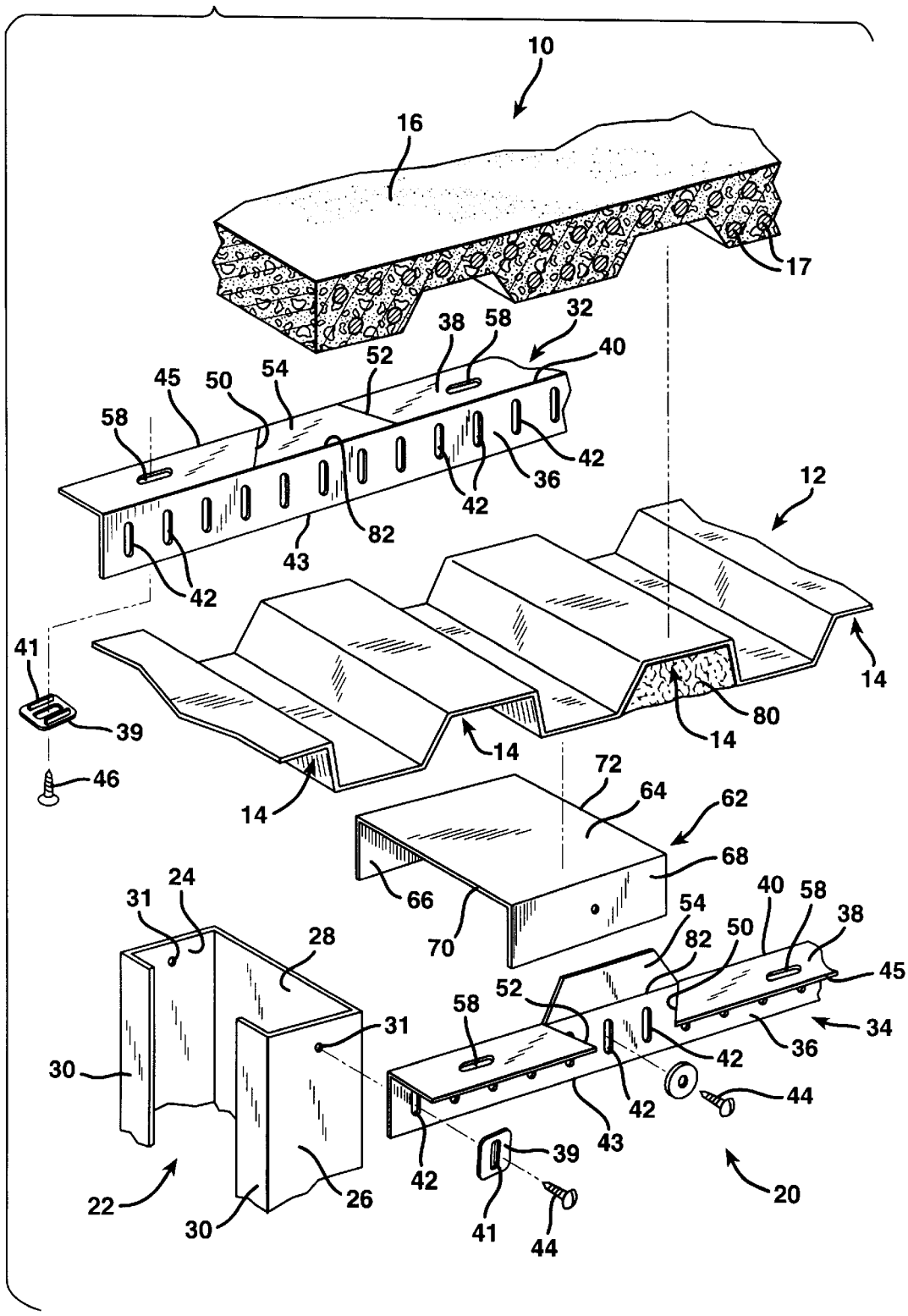
FIG. 1 is an exploded perspective view illustrating a seismic and fire-resistant interior head-of-wall structure according to the invention.
Figure 2:
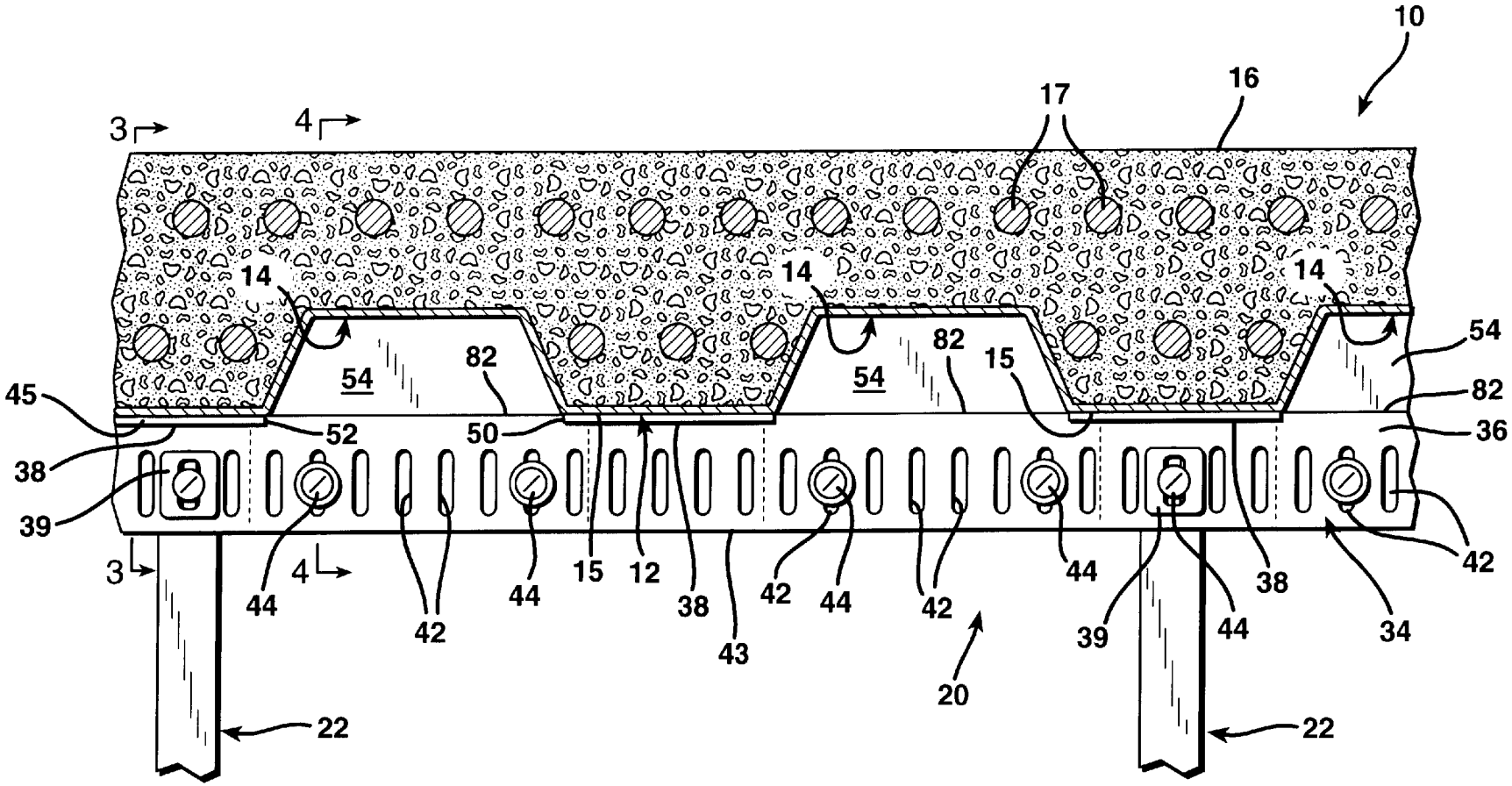
FIG. 2 is a sectional elevational view illustrating the head-of-wall structure of the invention installed beneath a ceiling in which the flutes of the ceiling deck extend perpendicular to the line of metal studs forming the wall.

FIG. 1 illustrates a portion of a building having a floor. A ceiling 10 is formed about nine feet above the floor. The ceiling 10 is formed of an expansive corrugated metal deck member 12 on the underside of which a plurality of concave, downwardly facing, channel-shaped flutes 14 are formed. Each of the flutes 14 is of generally trapezoidal cross section about six inches in maximum width and about three inches in depth. The expansive metal deck member 12 is preferably formed of eighteen gauge W3 galvanized steel fluted decking. The ceiling 10 also includes a layer of reinforced concrete 16 poured thereatop to a minimum thickness of about two and a half inches. The concrete 16 is normal weight and has number four steel reinforcement rods 17 therein.

Beneath the ceiling 10 there is a seismic and fire-resistant, interior head-of-wall structure indicated generally at 20. The wall culminating in the head-of-wall structure 20 is installed between the floor beneath and the ceiling 10. That wall is formed of a plurality of vertical, metal studs 22, each about one hundred seven and a half inches in height. The metal studs 22 terminate near the underside of the metal ceiling deck 12. Each of the metal studs 22 is formed three and five-eighths inches in width from 0.019 inch thick galvanized steel. The metal studs 22 are located in a straight, horizontal line, no less frequently than twenty-four inches on center, maximum. The studs 22 are more typically spaced at sixteen inch intervals.

Each of the studs 22 is formed from a single sheet metal structure bent into a configuration having stud side walls 24 and 26 of uniform width. The stud side walls 24 and 26 are bent perpendicularly out from a relatively broad, central web 28. The edges of the side walls 24 and 26 remote from the web 28 are turned over to form marginal lips 30 which enhance the structural rigidity of the studs 22. The studs 22 thereby have a generally "C-shaped" cross-section, as illustrated.

The top of the head-of-wall 20 is formed by a pair of angle strips 32 and 34 fabricated from a minimum of sixteen gauge galvanized steel. The angle strips 32 and 34 are of identical construction. Each angle strip 32 and 34 is of an inverted L-shaped cross-sectional configuration and includes a flat, vertically oriented leg 36 and an flat, horizontally oriented leg 38. Each of the angle strips 32 and 34 is formed from a flat strip of sheet steel that is bent at right angles to form an apex 40 that serves as a delineation between the vertical leg 36 and the horizontal leg 38. The vertical legs 36 depend from the horizontal legs 38 of the angle strips 32 and 34.

The vertically oriented angle legs 36 are fabricated with vertically elongated stud fastener openings 42 defined therethrough. The stud fastener openings 42 are each preferably about one-quarter inch in width and are spaced longitudinally from each other at regular one and one-half inch intervals. The stud fastener opening slots 42 are centered within the vertical legs 36 between the apex 40 of the angle strips 32 and 34 and the lower edge 43 of the vertical legs 36. Each vertical leg 36 is preferably two and one-half inches in height as measured between the apex 40 and the lower edge 43 thereof.

The horizontal legs 38 of the angle strips 32 and 34 project outwardly in opposite directions from each other and away from the vertical legs 36 thereof and from the studs 22. The horizontal legs 38 are also initially flat throughout their length and have an outer edge 45 remote from the vertical legs 36 and the apices 40.

The horizontal legs 38 are scored by slits 50 and 52 that extend entirely through the thickness of the sheet steel forming the horizontal legs 38. The slits 50 and 52 diverge from each other from the outer, horizontal leg edge 45 and terminate at the apex 40. The slits 50 and 52 extend across the width of the horizontal leg 38 from the outer edges 45 in toward the vertical legs 36 to define trapezoidal-shaped pop-up tabs 54. The size and shape of the trapezoidal pop-up tabs 54 corresponds closely to and is just slightly smaller than the cross-sectional size and shape of the flutes 14.

Elongated, longitudinally extending ceiling fastener openings 58 are defined in the horizontal angle legs 38 between the pop-up tabs 54. The ceiling fasteners openings 58 are elongated in a direction parallel to the line of metal studs 22.

In assembling the head-of-wall structure 20, the vertical legs 36 of the angle strips 32 and 24 are positioned in contact with the sides 24 and 26, respectively, of the metal studs 22. The horizontal legs 38 of the angle strips 32 and 34 are directed outwardly away from the metal studs 22 and are pressed into contact with the undersurface of the metal deck 12.

Seismic-resistant connections allowing limited vertical movement are provided between the vertically disposed legs of the angle strips and the sides of the upright studs. Seismic-resistant connections between the horizontal legs of the angle strips permit limited, interstory drift between the metal decking of the ceiling and the upright studs therebeneath.

Standoff washers 39 are provided for each of the elongated ceiling fastener slots 58. The structure and use of the standoff washers 39 is illustrated and described in U.S. Pat. No. 5,467,566, which is incorporated herein by reference. Each standoff washer 39 is a flat, preferably rectangular structure having an elongated slot 41 defined therein. The standoff washers 39 are preferably about seven-eighths of an inch in width and about three-quarters of an inch in length. The longitudinal slot 41 is preferably about three-eighths of an inch in length.

In the formation of the slots 41, the structure of each standoff washer 39 is deformed so as to provide a pair of ribs or lips that extend out from the otherwise planar structure of the standoff washer 39 a distance of about one-sixteenth of an inch. The lips extend longitudinally along the sides of the elongated slots 41.

A standoff washer 39 is positioned in each of the ceiling fastener slots 58 such that the lips thereof extend up through the horizontal legs 38 and protrude a very short distance therebeyond. Ceiling fasteners 46, which may be no. 10 powder actuated fastening screws, are fired from beneath the horizontal angle legs 38 and extend up through the standoff washers 39 positioned at the ceiling fastening slots 58, through the steel deck 12, and into the concrete 16. The ceiling fasteners 46 may be installed at eight or twelve inch intervals along the length of the horizontal angle legs 38, depending upon the spacing of the flutes 14 in the deck 12.

The heads of the fasteners 46 bear against the standoff washers 39 to hold the horizontal angle legs 38 up against the metal deck 12 of the ceiling 10. However, since the lips of the standoff washers 39 on both sides of the slots 41 therein contact the surface 15 of the deck 12, and since the slots 58 are greater in length than the length of the lips of the standoff washers 39, a certain amount of longitudinal movement is permitted between the deck 12 and the horizontal angle legs 38 when the head-of-wall 20 is subjected to seismic activity.

The lower ends of the studs 22 are secured to a floor sill track in a conventional manner. The upper extremities of the studs 22 are fastened to the vertical angle legs 36 of the angle strips 32 and 34 using standoff washers 39 and sheet metal framing screws 44. The function of the standoff washers 39 and the stud fastening slots 42 are described in U.S. Pat. No. 5,467,566 and in U.S. Pat. No. 5,127,203, respectively, both of which are hereby incorporated by reference.

A standoff washer 39 is positioned at the center of each slot 42 that is aligned with a stud 22. The standoff washer 39 is centered within the slot 42 and placed thereagainst so that the lips on each side of the standoff washer slot 41 project through the structure of the vertical angle legs 36 of the angle strips 32 and 34. The standoff washer lips project slightly beyond the thickness of the twenty-gauge stock forming the angle strips 32 and 34 so as to reside in contact with the side walls 24 and 26 of each stud 22.

The stud fastening screws 44 are then power driven through the standoff washer slots 41 into the structure of the stud side walls 24 and 26 therebeyond, thereby forming stud fastener openings 31 therein. By securing angle strips 32 and 34 to the studs 22 in this manner, the angle strips 32 and 34 are securely fastened to the studs 22. Nevertheless, the standoff washers 39 and the vertically elongated slots 42 permit a limited amount of relative vertical movement between the studs 22 and the angle strips 32 and 34, thereby providing resistance to seismic activity.

The head-of-wall structure 20 is further comprised of channel-shaped sections of insulation supporting bridges 62. Each bridge 62 has a flat, horizontally disposed web 64 from the edges of which channel legs 66 and 68 depend downwardly. The width of the insulation supporting bridges 62 between the depending legs 66 and 68 is substantially equal to the width of the studs 22 between the sides 24 and 26 thereof. The length of each insulation supporting bridge 62, as measured between the transverse edges 70 and 72 thereof is at least a great as the maximum width of the flutes 14. The webs 64 of the insulation supporting bridges 62 thereby form platforms that span the flutes 14 where the flutes 14 cross the horizontal line of studs 22.

The vertical side walls 66 and 68 of the insulation supporting bridges 62 reside in contact with the vertical legs 36 of the angle strips 32 and 34. The vertical side walls 66 and 68 of the insulation supporting bridges 62 are secured to the vertical legs 36 of the angle strips 32 and 34 by means of one-half inch length, pan head, self drilling or self-tapping no. 6 sheet metal screws 44 that extend through the vertically elongated openings 42 that lie directly beneath the flutes 14.

The portions of the flutes 14 that pass transversely across the line of studs 22 and the angle strips 32 and 34 located thereatop form cavities in the form of transverse tunnels. These cavities or tunnels are filled with batts 80 of an insulation material above the line of studs 22. In conventional interior building wall construction the cavities in the flutes above the nonload-bearing interior wall beams are filled with Monokote MK-6/CDF insulation as a fire insulating substance. Although Monokote is resistant to fire, it is somewhat brittle even when installed, and becomes more brittle as it ages. As a consequence, if the building is subjected to seismic activity, the metal decking in a floor above a nonload-bearing wall and the wall structure will move relative to each other. This movement causes the Monokote to be crushed in the flute cavities and to crumble and dissipate.

Preferably a superior insulating material is utilized to form the insulation batts 80. The insulation batts 80 are preferably formed of a compressible, nonflammable, mineral fiber insulation called safing. This mineral fiber substance is a fireproof material that is produced as a by-product of slag. It is heated and spun and resembles spun fiberglass in texture, although it is dark brown in color. More importantly, it is a spongy, resiliently compressible material that does not become brittle with age, nor with exposure to temperature extremes. Furthermore, it is extremely low in cost.

The mineral fiber insulation batts 80 are preferably cut slightly larger than the width of the insulation support 62 as measured between the vertical sides 66 and 68 thereof. Also, the insulation batts 80 are preferably initially cut to a height greater than the depths of the flutes 14.

Once the insulation batts 80 have been positioned atop the insulation supports 62, the pop-up tabs 54 are bent upwardly into a generally vertical orientation. Preferably, the demarcations between the vertical legs 36 and horizontal legs 38 of the angle strips 32 and 34 are partially scored along the portions 82 of the apices 40 between the slits 50 and 52 beneath the flutes 14. Once the insulation batts 80 have been positioned in the cavities or tunnels formed by the flutes 14 where they cross the insulation supporting bridges 62, an installer strikes each of the trapezoidal areas of the pop-up tabs 54 delineated by the die cuts 50 and 52. The hammer blows are delivered from beneath the undersides of the horizontal legs 38 of the angle strips 32 and 34. Since the portions 82 of the apices 40 are weakened by partial scoring, the forces from the hammer blows inelastically bend the pop-up tabs 54 upwardly and inwardly in toward each other about the lines of bending formed by the partially scored portions 82 of the apices 40. The pop-up tabs 54 may thereby be bent upwardly into a generally vertical orientation, generally parallel to the vertical legs 36 of the angle strips 32 and 34 and in substantially coplanar relationship therewith.

When the pop-up tabs 54 have been bent up into a vertical position, they extend as transverse blocking partitions substantially across the entire width of each flute 14. An enclosure 84 is thereby formed within which each insulation batt 80 is confined. The upper portions of the enclosures 84 are formed by that portion of the sheet metal deck 12 forming the top and inclined walls of the trapezoidal-shaped flutes 14. The bottom of the enclosures 84 are formed by the web 64 of the insulation supporting bridges 62. The ends of the enclosure 84 are formed by the pop-up tabs 54 of the angle strips 32 and 34, respectively.

Figure 3:
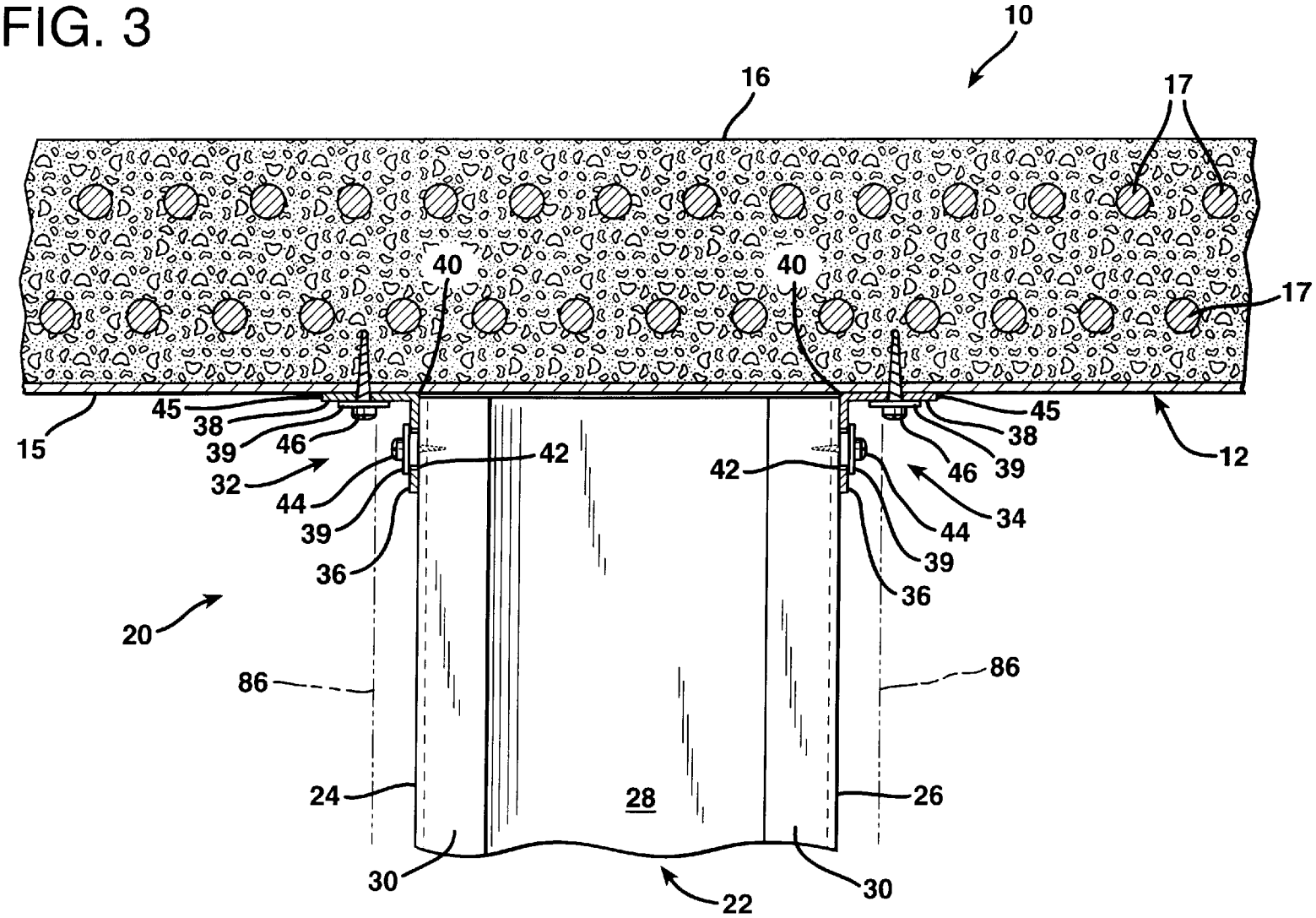
FIG. 3 is a sectional elevational view taken along the lines 3—3 of FIG. 2.
Figure 4:
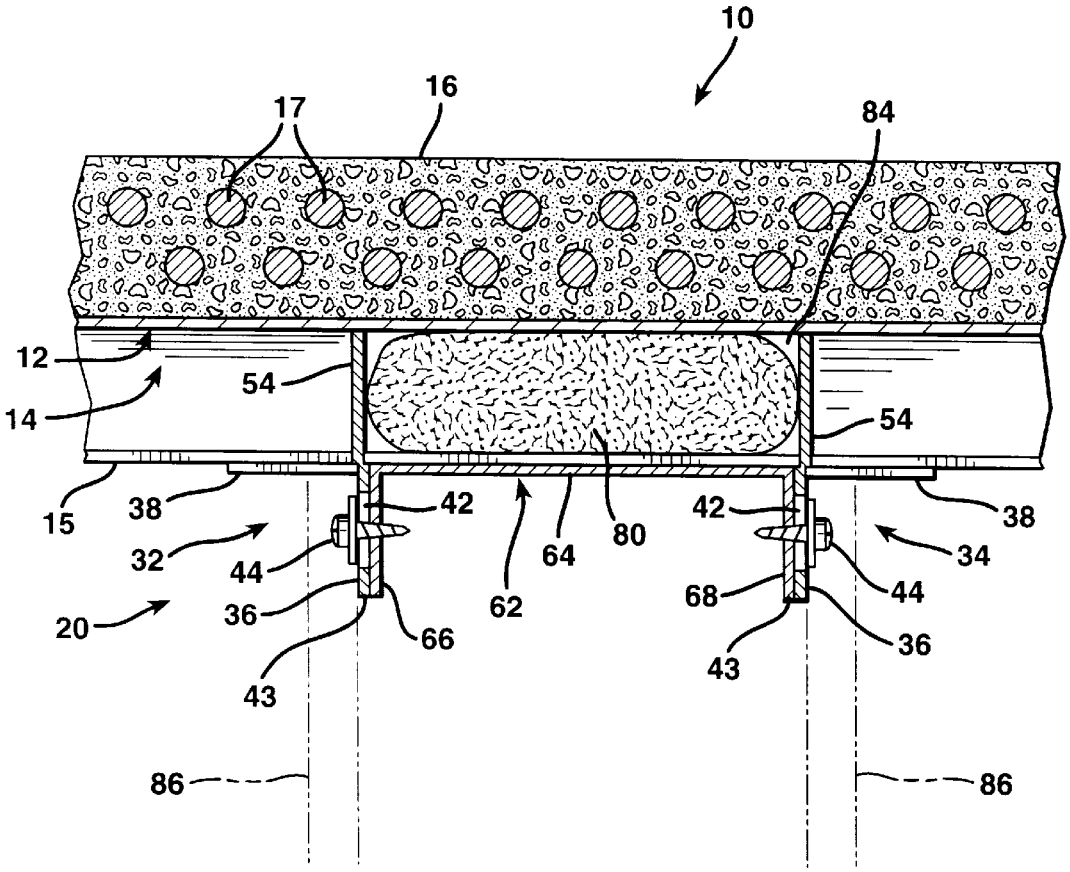
FIG. 4 is a sectional elevational view taken along the lines 4—4 of FIG. 2.

As is evident from FIG. 4, the insulation batts 80 are encapsulated within the enclosures 84 and cannot be dislodged even by high pressure on either side of a wall formed at the line of studs 22. Once the head-of-wall structure 20 is completed as depicted in the drawings, wallboard sheets are mounted against the opposite sides 24 and 26 of the vertical studs 22. The wallboard sheets are conventional three-quarter or five-eighths inch thick type "X" gypsum board panels, indicated in phantom at 86 in FIGS. 3 and 4. The wallboard panels 86 are attached to the studs 22 in a conventional manner by self-tapping screws.

The wall forming the head-of-wall structure 20 was then subjected to a hose test. Water under pressure was fired at the pop-up tabs 54 to see if the insulation batts 80 could be dislodged therefrom using water pressure. Water under a pressure of forty psi in a two inch diameter fire hose was fired from a distance of twenty feet to impact directly against the pop-up tabs 54. The water pressure was selected so as to simulate the pressure of smoke in a room at the fire stop level.

Unlike comparable wall sections in which the unique construction of the head-of-wall 20 was not employed, the wall section 20, in accordance with the invention, easily passed the hose stream test. The pop-up tabs 54 prevented dislodgement of any sort of the mineral fiber batts 80 from the enclosures 84 formed in the flutes 14 above the insulation supporting bridges 62.

The use of elongated angle strips mounted at the upper extremities of the sides 24 and 26 of the studs 22 in place of a downwardly facing sheet metal channel spanning the sides of the studs has several advantages. Specifically, a single size of elongated angle strip may be utilized in any interior head-of-wall installation. The widths of studs does vary in building construction. There are currently six different stud widths in use in present-day building construction which vary between two and a half and six inches in width. In conventional practice this requires the availability of channel beams having six different widths. In contrast, the same size angle strip may be utilized in constructing a head-of-wall according to the present invention regardless of the width of the studs employed. This eliminates the need for different dies and sheet metal bending setups in the fabrication of the structural materials utilized to connect the studs to the sheet metal decking above.

A pair of angle strips are significantly lighter in weight than a channel beam of the same length. Also, the angle strips of the invention can be installed one at a time. The angle strips employed in the head-of-wall construction according to the invention are thereby far easier to manipulate than a channel beam of the same length. Therefore, they can be installed much more rapidly, thus reducing both the time and expense of fabrication of a head-of-wall structure.

Undoubtedly, numerous variations and modifications of the invention will become readily apparent to those familiar with fire retardant and seismic resistant building wall construction. For example, the dimensions of the angle strips, fastener slot openings, and the size and selection of sheet metal stock and fasteners may be varied. Accordingly, the scope of the invention should not be construed as limited to this specific embodiment depicted and described herein.

I claim:

1. In a building interior head-of-wall structure for a nonload-bearing wall in which a plurality of vertical metal wall studs are arranged in a straight horizontal line and project upwardly and terminate beneath a ceiling formed of a metal deck having an exposed undersurface that defines a plurality of mutually parallel, concave downwardly facing flutes, the improvement comprising a pair of sheet metal angle strips that join said wall studs to said ceiling deck, wherein said angle strips each include a vertical leg secured to said metal wall studs and a horizontal leg having an outer edge remote from said vertical leg, and said horizontal leg is scored toward said vertical leg at longitudinally spaced intervals along said outer edge to define a plurality of pop-up tabs that are bent to project upwardly into and block said flutes on both sides of said line of metal wall studs.

2. A head-of-wall structure according to claim 1 wherein said flutes extend transversely across said line of metal studs, and further comprising batts of fire-resistant insulation located in each of said flutes directly above said line of wall studs and said pop-up tabs of said pair of angle strips confine said batts of insulation therebetween within said flutes.

3. A head-of-wall structure according to claim 2 further comprising channel-shaped insulation supporting bridges having downwardly depending legs secured to said pair of angle strips beneath each of said batts of insulation, whereby said batts of insulation are confined on all sides within said flutes and are supported from beneath by said insulation supporting bridges above said line of metal studs.

4. A head-of-wall structure according to claim 1 wherein said downwardly facing flutes each have a trapezoidal configuration and said horizontal legs of said angle strips are scored with slits diverging from said outer edge thereof to create said pop-up tabs in a trapezoidal shape corresponding to that of said flutes, and further comprising ceiling fastener openings defined in said horizontal angle legs between said pop-up tabs, and said ceiling fastener openings are elongated in a direction parallel to said line of metal wall studs.

5. A head-of-wall structure according to claim 4 further comprising a ceiling fastener slip washer located in at least some of said ceiling fastener openings and ceiling fastening screws extending through said ceiling fastener slip washers and through said horizontal legs of said angle strips thereby attaching said horizontal legs of said pair of angle strips to said metal deck.

6. A head-of-wall structure according to claim 5 further comprising vertically elongated stud fastener openings defined in said vertical angle legs, stud fastener slip washers located in at least some of said stud fastener openings and at each of said studs, and stud fastening screws extending through said stud fastener slip washers through said vertical legs of said angle strips, and into said studs to attach said vertical legs of said pair of angle strips to said vertical studs thereby to permitting limited relative horizontal and limited relative vertical movement between said studs and said metal deck.

7. A head-of-wall structure according to claim 1 wherein said pop-up tabs are partially scored above said vertical legs of said angle strips and in a direction parallel to said line of studs.

8. In combination, a building ceiling formed of a metal deck having an undersurface that defines a plurality of mutually parallel, concave downwardly facing flutes; a plurality of upright, channel-shaped sheet metal wall studs arranged in a straight horizontal line, each stud having a vertically disposed web between a pair of opposing sides, wherein said studs are located beneath and extend proximate to said undersurface of said metal deck; a pair of elongated angle strips each having a vertical leg and a horizontal leg, wherein said vertical legs of said angle strips are formed with vertically elongated stud fastener openings therein and said horizontal legs are formed with horizontally elongated ceiling fastener openings therein, and said angle strips are respectively arranged against said opposing sides of said wall studs with their vertical legs in contact therewith and with their horizontal legs projecting outwardly therefrom away from each other, and said horizontal legs have outer edges and are slit from said outer edges in toward said vertical legs to define pop-up tabs that have lines of bending parallel to said vertical legs and which are bent up to extend into said downwardly facing flutes; stud fasteners extending into said metal studs through at least some of said stud fastener openings to secure said vertical legs of said angle strips to said sides of said studs while permitting limited relative vertical movement therebetween; and ceiling fasteners extending into said ceiling through at least some of said ceiling fastener openings to secure said horizontal legs of said angle strips to said ceiling while permitting limited relative horizontal movement therebetween.

9. A combination according to claim 8 wherein said angle strips are partially scored along said lines of bending.

10. A combination according to claim 8 wherein said pop-up tabs are of a size and shape to extend across and block said flutes across the entire cross-sectional areas thereof.

11. A combination according to claim 10 wherein said flutes cross over said line of studs in perpendicular orientation relative thereto, and further comprising batts of fire insulation located in said flutes where they cross over said line of studs and said pop-up tabs are bent up into said flutes to confine said batts of insulation in spaces within said flutes directly above said line of vertical studs.

12. A combination according to claim 11 further comprising insulation supports located beneath each of said batts of insulation and secured to said angle strips and spanning the distance between said angle strip to thereby support said batts of insulation from beneath.

13. A combination according to claim 12 wherein said insulation supports are comprised of short, channel-shaped bridge members having a length equal to at least the maximum width of said flutes and said bridge members have vertical side walls that reside in contact with said vertical legs of said angle strips and said vertical side walls of said insulation supports are secured to said vertical legs of said angle strips.

14. A combination according to claim 8 wherein said stud fasteners and said ceiling fasteners are both comprised of slip washers disposed within each of said elongated openings and sheet metal screws that pass through said slip washers.

15. A seismic and fire-resistant interior head-of-wall structure installed between a ceiling formed of a metal deck having an exposed undersurface that defines a plurality of mutually parallel, concave downwardly facing flutes, a plurality of vertical metal studs extending upwardly and arranged in linear alignment with each other and terminating near said ceiling beneath said undersurface thereof, a pair of elongated, sheet metal angle strips each having a vertical leg and a horizontal leg and positioned beneath said undersurface of said ceiling with said vertical legs of said angle strips depending from said horizontal legs thereof and residing in contact with said metal studs and with said horizontal legs of said angle strips directed outwardly away from said metal studs and residing in contact with said undersurface of said metal deck, and wherein said angle strips are formed with a plurality of vertically elongated stud fastener openings defined in said vertical legs of said angle strips and a plurality of horizontally elongated ceiling fastener openings defined in said horizontal legs of said angle strips and extending parallel to said alignment of said studs relative to each other, stud fasteners extending through at least some of said stud fastener openings and into said metal studs to secure said vertical legs of said angle strips to said vertical studs so as to permit relative vertical movement between said angle strips and said vertical studs limited by the lengths of said stud fastener openings, and ceiling fasteners extending through at least some of said ceiling fastener openings and into said metal deck to secure said horizontal legs of said angle strips to said metal deck so as to permit relative horizontal movement between said ceiling and said angle strips limited by the lengths of said ceiling fastener openings, and further characterized in that slits are formed in said horizontal legs of said angle strips so as to define pop-up tabs in said horizontal legs which are of a size that fit into and extend transversely across said downwardly facing flutes.

16. A head-of-wall structure according to claim 15 wherein said horizontal legs of said angle strips have outer edges remote from said vertical legs, and said horizontal legs are scored with transverse die cut slits extending from said outer edges thereof to said vertical legs to thereby define said pop-up tabs.

17. A head-of-wall structure according to claim 16 wherein said angle strips are partially scored between said traverse die cut slits to facilitate bending said pop-up tabs into a vertical disposition.

18. A head-of-wall structure according to claim 17 wherein said flutes cross said angle strips in perpendicular orientation relative thereto, and further comprising insulation supports located beneath each of said flutes between said angle strips, and batts of insulation located thereabove and confined in their positions within said flutes directly above said linear alignment of said vertical metal studs, by said pop-up tabs of said angle strips.

19. A head-of-wall structure according to claim 18 further comprising insulation supports secured to said angle strips and located directly beneath said batts of insulation to support said batts of insulation and confine said batts of insulation in their positions within said flutes from beneath.

* * * * *